US007966671B2

(12) United States Patent
Cho

(10) Patent No.: US 7,966,671 B2
(45) Date of Patent: Jun. 28, 2011

(54) HEADWEAR

(75) Inventor: Byoung-Woo Cho, Yongin (KR)

(73) Assignee: Yupoong, Inc., Seoul (KR)

( * ) Notice: Subject to any disclaimer, the term of this patent is extended or adjusted under 35 U.S.C. 154(b) by 941 days.

(21) Appl. No.: 10/763,223

(22) Filed: Jan. 26, 2004

(65) Prior Publication Data

US 2005/0160518 A1 Jul. 28, 2005

(51) Int. Cl.
*A42C 5/02* (2006.01)

(52) U.S. Cl. ..... 2/181; 2/209.12; 2/171; 2/195.1; 139/416; 139/421; 139/422

(58) Field of Classification Search ..... 2/209.12, 2/171, 195.1; 139/416, 420 R, 421, 422, 139/423, 426 R
See application file for complete search history.

(56) References Cited

U.S. PATENT DOCUMENTS

| | | | | | |
|---|---|---|---|---|---|
| 1,459,547 | A * | 6/1923 | Moore et al. | 139/421 |
| 1,922,944 | A * | 8/1933 | Gobeille | 139/421 |
| 2,040,657 | A * | 5/1936 | Kops et al. | 139/421 |
| 2,144,667 | A * | 1/1939 | Stein | 66/192 |
| 2,268,809 | A * | 1/1942 | De Roon | 139/419 |
| 2,327,756 | A * | 8/1943 | Adamson | 219/545 |
| 2,379,580 | A * | 7/1945 | Hendley | 219/529 |
| 2,384,936 | A * | 9/1945 | Lilley et al. | 442/184 |
| 2,749,947 | A * | 6/1956 | Slough | 139/423 |
| 2,995,154 | A * | 8/1961 | Seltzer | 139/383 R |
| 4,941,210 | A * | 7/1990 | Konucik | 2/171 |
| 5,146,630 | A * | 9/1992 | Richard | 2/181 |
| 5,715,540 | A * | 2/1998 | Cho | 2/195.3 |
| 6,131,202 | A * | 10/2000 | Yan | 2/195.3 |
| 6,347,410 | B1 * | 2/2002 | Lee | 2/181 |
| 6,557,180 | B2 * | 5/2003 | Hall McKenzie | 2/195.1 |
| 2002/0000001 | A1 * | 1/2002 | Hall McKenzie | 2/195.2 |

FOREIGN PATENT DOCUMENTS

| | | |
|---|---|---|
| WO | WO 01/05259 | 1/2001 |
| WO | WO0105259 A1 * | 1/2001 |

OTHER PUBLICATIONS

Lord, P.R.; Mohammed, M.H. Weaving: Conversion of Yarn to Fabric Merrow Publishing Co. p. 17-19.*

Lord, P.R.; Mohammed, M.H. Weaving: Conversion of Yarn to Fabric 1992 Merrow Publishing Co. pp. 17-19 and 157-161.*

Lord, P.R.; Mohammed, M.H. Weaving: Conversion of Yarn to Fabric; Merrow Publishing Co.; p. 17-19;157-161.*

* cited by examiner

*Primary Examiner* — Alissa L Hoey
*Assistant Examiner* — Alissa J Tompkins
(74) *Attorney, Agent, or Firm* — Staas & Halsey LLP

(57) ABSTRACT

Disclosed is a headwear which has remarkably improved stretch property and comfortably fits for the head of a wearer. The headwear comprises a head receiving part made of a multiple fabric and a sweatband peripherally attached to an inner side of the head receiving part along a lower edge thereof. Since the multiple fabric has much more improved stretch property than the stretchable fabric of the conventional free size cap, the headwear can fit a very wide range of head sizes and provide a comfortable sense of wearing, without any sense of pressing even though the cap is used for a long time.

19 Claims, 7 Drawing Sheets

HEADWEAR

BACKGROUND OF THE INVENTION

1. Field of the Invention

The present invention relates to headwear, and more particularly, to headwear that is made of a fabric with an improved elasticity and can be thus adapted to various head sizes of wearers without an additional size adjustable mechanism.

2. Description of the Prior Art

Generally, a baseball-type cap includes a crown, a visor and a sweatband. The crown is used for covering the head of a wearer to protect the wearer's head and secure the cap on the head. Most of the crowns take the shape of a general hemisphere corresponding to a shape of the wearer's head. The crown includes several panels that are stitched together and connected with one another to define a single crown.

The visor is stitched and fixed to the front of the crown. The visor defines a shield adjacent to the face of the wearer to shield direct sunlight. A hat or a sun cap may be formed with a brim around the crown to perform the same function as that of the visor in the baseball-type cap.

The sweatband is attached to the crown along a lower edge of the inside of the crown and is formed as a band corresponding to the periphery of the wearer's head. The sweatband prevents sweat from running down from the inside of the crown and lightly presses the wearer's head into direct contact with the head so that the cap cannot be easily taken off from the head.

Since the head sizes vary according to the wearers, the cap should be manufactured in consideration of various head sizes of the wearers. Accordingly, a variety of methods of adjusting the cap in accordance with the various head sizes have been presented.

In general, an adjustable cap and a free size cap are provided as a cap capable of adjusting the size of a crown in accordance with the head size.

The adjustable cap is configured in such a manner that the size along a lower edge of the crown can be adjusted in accordance with the head size of the wearer using a size adjustable means attached to one side of the lower edge of the crown.

The conventional adjustable cap includes a visor and a crown, and the crown is composed of several gores. A sweatband may be prepared on an inner face of the crown according to the manufacturer's selection.

An opening is formed at the rear side of the crown opposite to the visor. A strap is attached to one end of the opening and a buckle is attached to the other end thereof, so that the size along the lower edge of the crown can be adjusted. That is, the buckle can adjust the length of the strip, and thus, the wearer can adjust the size of the adjustable cap by adjusting the length of the strap in accordance with his/her head size.

However, the adjustable cap has a problem in that external appearances are not good because the opening is exposed at the rear of the cap and some hairs of the wearer come off from the opening. Further, according to the length of the strap, wrinkles may be formed on the cap and the shape of the cap may be deformed. Moreover, there is another problem in that the size adjustment is very cumbersome because different wearers should adjust the length of the strap in accordance with their head sizes whenever they intend to put on the cap.

To overcome the above problems related to the conventional adjustable cap, the free size cap has been proposed. The conventional free size cap can be applied to a wide range of the head sizes because it is made of a stretchable fabric. In the free size cap, gores of the crown generally comprise the stretchable fabric.

The conventional stretchable fabric comprises warps disposed in a longitudinal direction of the fabric and wefts disposed perpendicular to the warps. The gores in the conventional free size cap can be stretched only by the elasticity of the warps and the wefts because the warps and wefts are disposed in a single layer, respectively (see FIG. 2 and FIG. 3(B)).

U.S. Pat. No. 6,131,202 to Yan relates to a multi-axially stretchable cap. According to the Yan patent, the gores of the cap are composed of multi-axially stretchable fabric, in which stretchable synthetic fiber are woven in both directions, as weft and wrap. Also, a sweat band includes a thin layer of synthetic foam material. Thus, the stretchable cap can stretch in weft and warp direction to provide an easy fit for the head.

U.S. Pat. No. 6,347,410 to Lee relates to a self-sizing cap. The self-sizing cap of the Lee patent includes a crown portion, a visor and a sweat band. The crown portion is composed of triangle-shaped fabric panels and it can accommodate a range of head sizes comfortably. The sweat band is composed of two or more layers shaped as an elongated rectangle. The lower edge of the sweat band is flexibly attached to the lower peripheral edge of the crown portion, such that the sweat band can be stowed or deployed. When the sweat band is deployed, it can expand attachment area on the wearer's head and provide more shade and warmth, and also it can have matching or contrasting color combinations.

PCT application No. WO01/05259 relates to a cap with stretchable band. The cap includes a crown and an inner band, wherein the inner band is elastically stretchable at the least along its direction of elongation and includes a liner for encircling the head comfortably. The crown is composed of gores and at least one of the gores is made of elastically stretchable material.

The abovementioned three patents all are related to free size caps, in which the warps or wefts in the caps may expand in accordance with the head size of the wearer and the size of the crown may also change as the warps or wefts expand. However, since the warps or wefts are formed as one layer, the stretchable range of the conventional free size cap is relatively limited.

Furthermore, even slight expansion of the free size cap allows the cap to press the wearer's head with excessive pressure. Thus, if the wearer wears the cap for a long time, he/she may feel a pain and unseemly tracks may be formed on his/her forehead, etc.

SUMMARY OF THE INVENTION

It is an object of the present invention to provide headwear that is adjustable in accordance with the head size of a wearer and comfortably fits into the head.

It is another object of the present invention to provide headwear that slightly presses the head so as to present a good sense of wearing for a long time.

According to the preferred embodiments of the present invention, the headwear includes a head receiving part and a sweatband.

The head receiving part secures the cap on the head and corresponds to a crown of a baseball-type cap or a hat and a headband of a visor-type cap. The crown includes several panels that are connected with one another to define a hemispheric crown.

The head receiving part is partially or entirely composed of multiple fabric to exhibit a remarkably improved stretchable property. The head receiving part is also applicable to a wider range of head sizes since the head receiving part made of the multiple fabric can expand about twice as large as the conventional free size cap.

Further, the sweatband includes a band core made of a soft material to comfortably wrap the head of the wearer and simultaneously not to excessively press the head when the wearer wears the cap. Thus, it can provide a comfortable sense of wearing without any sense of pressing even though the cap is used for a long time.

Almost all kinds of multiple fabrics can be employed in the present invention. That is, a warp multiple fabric in which warps are formed in multiple layers or a warp-weft multiple fabric in which the warps and wefts are formed in multiple layers can be employed in the present invention. In particular, warp double fabrics or warp-weft double fabrics have generally been widely used as double fabrics. Since the weft is disposed approximately in a circumferential direction of the head or with a slight inclination in the multiple fabric, it can be effectively stretched in the circumferential direction.

Further, the weft in the multiple fabric is composed of a stretchable fabric, which is uniaxially stretchable, so that it can maintain the shape of the cap and expand along with positional displacement of the multiple warps when wearing the cap. Thus, a remarkably improved stretch property can be provided.

The sweatband is disposed on an inner face of the crown along a lower edge of the crown. Since a band core made of a soft material is comfortably wrapped around the head, it does not excessively press the head even though the headwear is used for a long time. Herein, the soft material may include a soft cloth fabric such as a woven fabric, a knit fabric and a non-woven fabric, and soft synthetic resin foam such as polyurethane foam. The stretchable fabric for covering the band core may also be composed of the multiple fabric.

The headwear of the present invention can be applied to a very wide range of the head sizes because it is made of the multiple fabric. Further, since the headwear of the present invention is comfortably wrapped around the head, it does not excessively press the head even though it is worn for a long time.

Furthermore, the shape of the head receiving part can be kept constant for a long time since the lower ends of the crown and the sweatband are engaged with each other by press stitching them with a highly stretchable yarn.

In addition, a baseball-type cap can be manufactured by fixing a visor at the front of the head receiving part, and a hat can also be manufactured by forming a brim along the periphery of the crown.

BRIEF DESCRIPTION OF THE DRAWINGS

The above objects and other advantages of the present invention will become apparent by describing preferred embodiments thereof in detail with reference to accompanying drawings, in which.

DESCRIPTION OF THE PREFERRED EMBODIMENTS

Hereinafter, preferred embodiments of a headwear of the present invention will be described with reference to the accompanying drawings.

Embodiment 1

Figure 1:
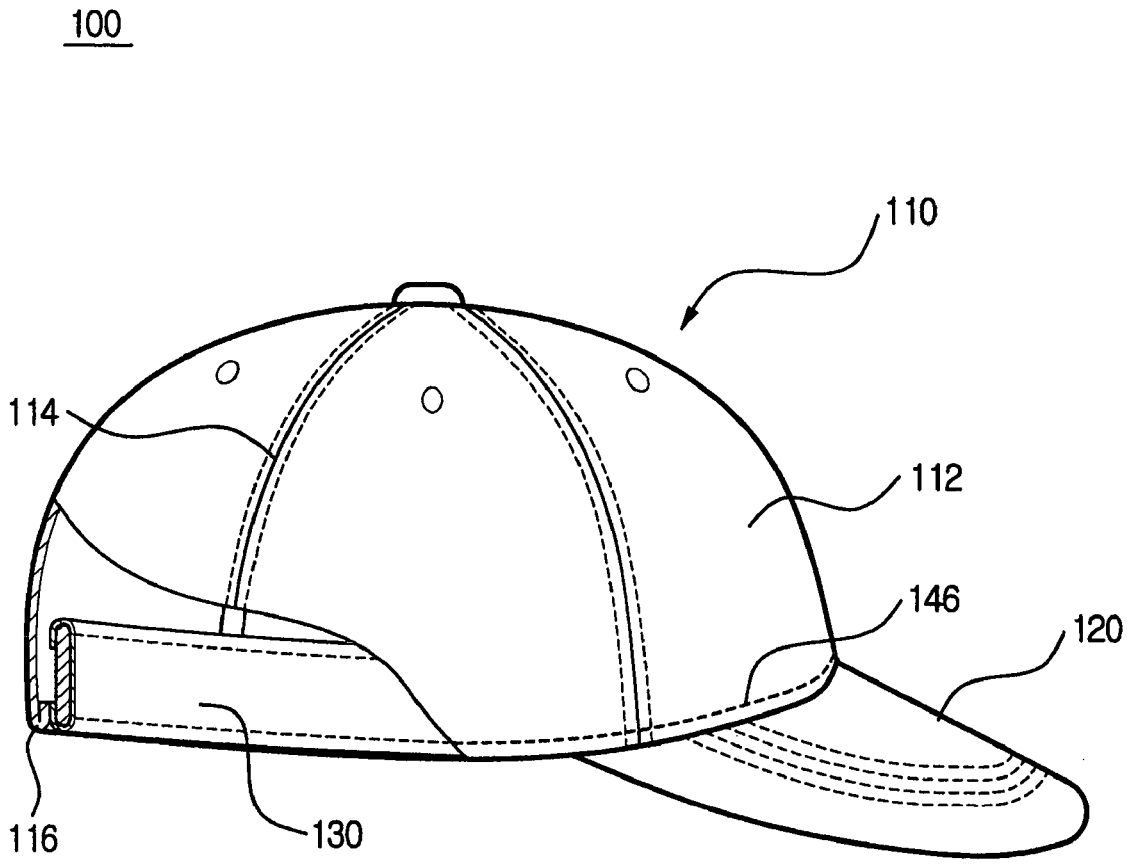
FIG. 1 is a partial cut-away view of a headwear according to the first embodiment of the present invention.

FIG. 1 is a partial cut-away view of a headwear according to a first embodiment of the present invention. Although the first embodiment of the present invention will be described based on the headwear including a visor, the description thereof can be similarly applied to various kinds of caps such as hats including a brim or an Ivy cap including two or three panels.

Referring to FIG. 1, a headwear 100 according to the first embodiment includes a crown 110, a visor 120 and a sweatband 130.

The crown 110 includes a plurality of panels that are connected with one another to define the crown 110. Since the panels 112 are stitched together and connected with one another, inseams are formed between the adjacent panels and covered with bias tapes 114 which are formed along the inseams on an inner face of the crown 110. The bias tapes 114 can also function to prevent gores 112 from being expanded or deformed.

Each of the gores 112 is composed of a double fabric. Wefts in the double fabric are disposed in a peripheral direction of the head or with slight inclination to the peripheral direction of the head so that the gore can be stretched in the peripheral direction of the head.

Figure 2:
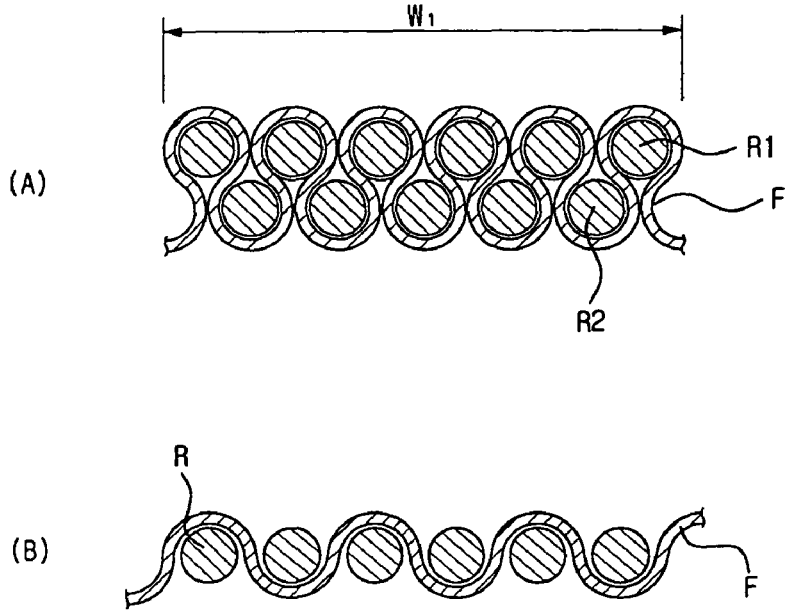
FIG. 2 is a partial sectional view of double fabric of the present invention and conventional elastic fabric for explaining their respective not-stretched states.
Figure 3:
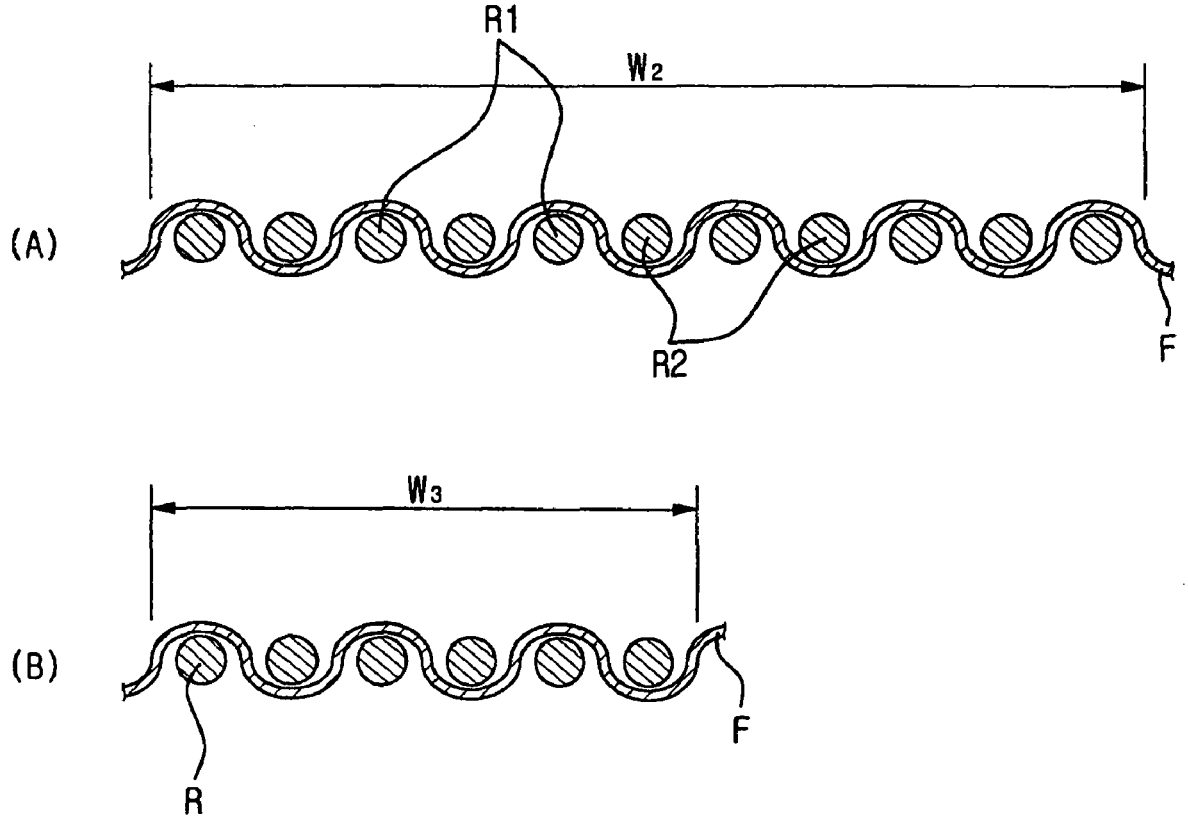
FIG. 3 is a partial sectional view of the double fabric of the present invention and the conventional elastic fabric for explaining their respective stretched states.

FIG. 2 is a sectional view showing a state before the double fabric of the headwear according to the first embodiment of the present invention and a fabric of the conventional free size cap are stretched. FIG. 3 is a sectional view showing a state after the double fabric and the conventional fabric shown in FIG. 2 are stretched.

Referring to FIGS. 2 and 3, the double fabric A according to the first embodiment of the present invention comprises first warps R1, second warps R2 and wefts F. The first warps R1 form an upper layer and the second warps R2 form a lower layer adjacent to the first warps R1. The wefts F form a loop structure while alternately passing through the first warps R1 and the second warps R2.

The first and second warps R1 and R2 may comprise the same or different kinds of yarns. Alternatively, the first warps R1 comprise cotton yarns (for example, P/C combed yarns), and the second warps R2 comprise utility yarns to add a specific property of the desired utility yarn to the double fabric. For example, if poly-DTY (Draw Textured Yarn) is used in the second warps R2, a drape feature for stably maintaining the shape of the cap can be remarkably improved. In addition, the utility yarns with different features can be used in the first or second warps so as to exhibit a variety of properties.

The wefts F comprise stretchable yarns such as spandex, polyurethane or high twist yarn and alternately pass through the first and second warps R1 and R2 to form the loop structure. Similarly to a knit fabric, the wefts F form the loop structure and include the stretchable yarns in the woven fabric. Thus, the double fabric A including the loop-shaped wefts F can be stretched in a remarkably wide range.

As illustrated in FIG. 3, when the first warps R1 and the second warps R2 disposed in a vertical direction extend to be disposed approximately in a line, the fabric of the present invention can be extended in a remarkably wider range as compared with the conventional fabric B. Even though the initial lengths W1 are substantially the same as each other, the length W2 to which the double fabric A can be extended to the utmost is much longer than the maximum extended length W3 of the conventional fabric.

Therefore, since the crown 110 made of the double fabric A can be stretched in a range much wider than that of the conventional free size cap, the headwear (i.e., free size cap) of the present invention can be applied to a much wider range of the head sizes. Thus, the headwear of the present invention can provide a very small pressing force around the head of the wearer.

The first warps R1, the second warps R2 and the wefts F form a warp double fabric and are woven by a variety of methods such as plain weave, twill weave and satin weave. A specific weaving method of manufacturing the double fabric may vary according to the intention of a designer and should not be limited to the aforementioned methods including the twill weave and the like. Moreover, though the headwear of this embodiment is mainly composed of the double fabric, other multiple fabrics such as three ply cloth and four ply cloth may be used to compose headwears according to the intention of a designer.

The visor 120 is attached to a lower edge of the crown 110 at the front thereof and functions to shield direct sunlight. The sweatband 130 is attached to the inner face of the crown 110 and can absorb sweat running down from the wearer's head.

Figure 4:
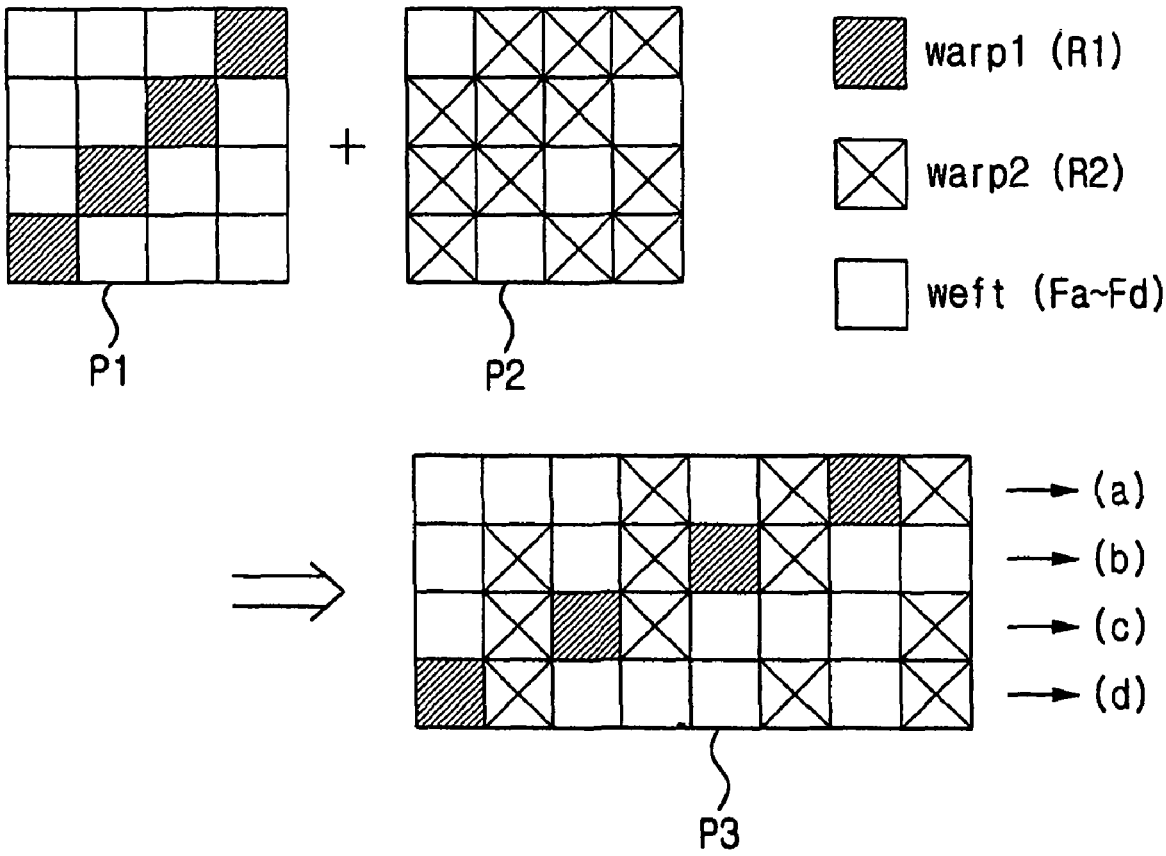
FIG. 4 is a schematic view showing patterns of another double fabric according to another example as a substitute for the double fabric shown in FIGS. 2 and 3.
Figure 5:
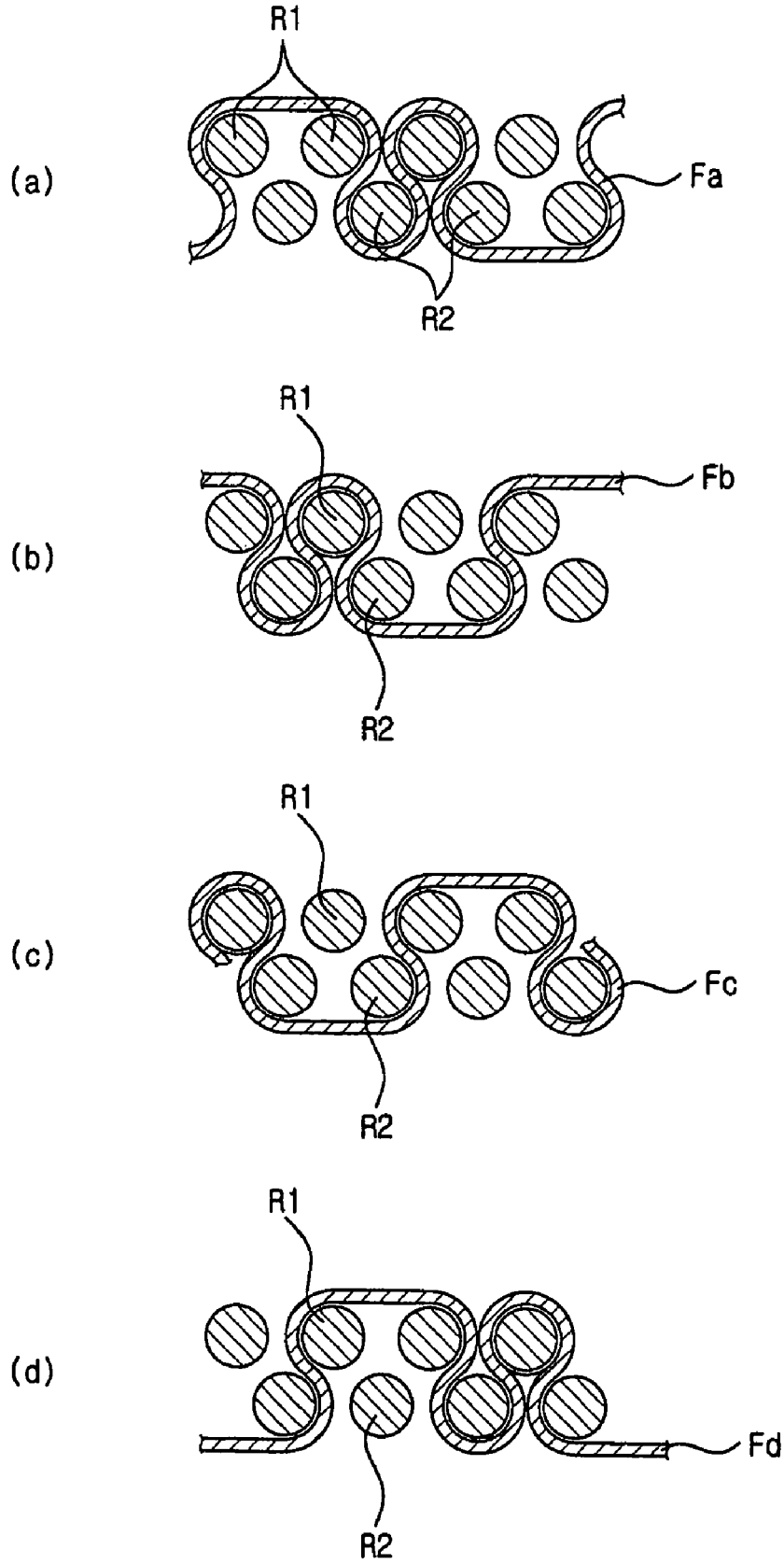
FIG. 5 is a sectional view showing states at (a) to (d) before the double fabric shown in FIG. 4.

FIG. 4 is a schematic view showing patterns of another double fabric according to another example as a substitute for the double fabric shown in FIGS. 2 and 3. FIG. 5 is a sectional view showing states at (a) to (d) before the double fabric shown in FIG. 4.

Referring to FIGS. 4 and 5, the double fabric includes first warps R1, second warps R2 and wefts Fa~Fd. The first warps R1 form an upper layer and the second warps R2 form a lower layer adjacent to the first warps R1. The wefts Fa~Fd form a loop structure while passing in zigzag through one or more of the first warps R1 or the second warps R2. The first and second warps R1 and R2 may comprise the same or different kinds of yarns. The wefts F comprise stretchable yarns such as spandex or polyurethane.

A first pattern P1 might be woven out of the first warps R1 and the wefts Fa~Fd, and a second pattern P2 might be woven out of the second warp R2 and the wefts Fa~Fd, in a style of twill weave. The third pattern P3 for the double fabric can be formed by joining the first pattern P1 and the second pattern P2, and the third pattern P3 is repeated to form the double fabric.

As shown in FIG. 5, the wefts Fa~Fd pass in zigzag through one or more of the first or second warps R1 or R2 to form the loop structure. Similarly to a knit fabric, the wefts Fa~Fd form the loop structure and include the stretchable yarns in the woven fabric. Thus, the double fabric including the loop-shaped wefts Fa~Fd can be stretched in a remarkably wide range. For example, in (a) of FIG. 5, the weft Fa is interlaced over first warp R1 and first warp R1, and then interlaced down second warp R2, and then interlaced over first warp R1, and then interlaced down second warp R2 and second R2, left-to-right in order. The first warps R1, the second warps R2 and the wefts Fa~Fd form a warp double fabric and are woven by a variety of methods such as (b), (c) and (d) in FIG. 5.

Figure 6:
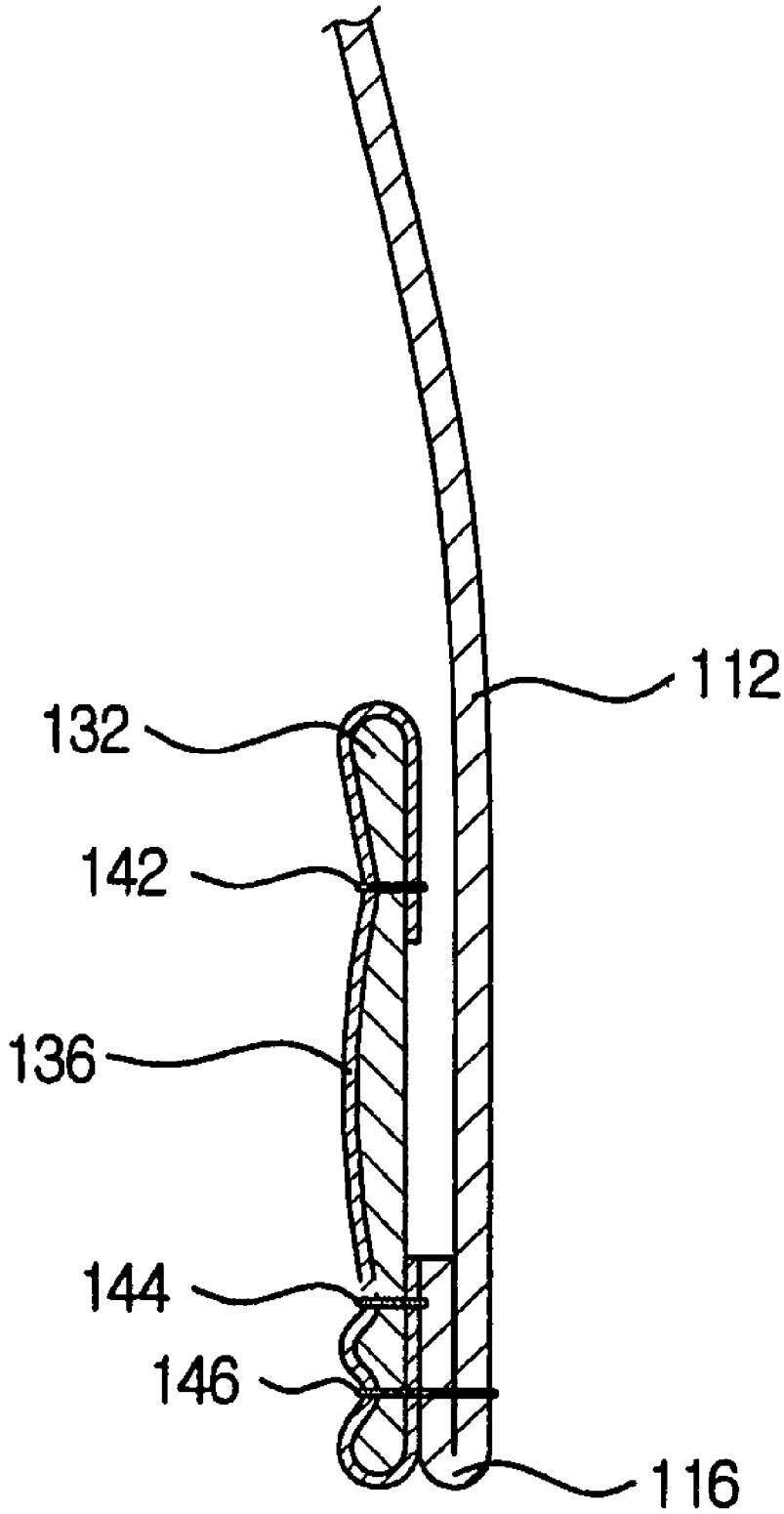
FIG. 6 is a sectional view of a sweatband of the headwear of FIG. 1.

FIG. 6 is a partial sectional view illustrating the sweatband of the headwear according to the first embodiment of the present invention.

Referring to FIGS. 1 and 6, the sweatband 130 is attached to the crown 110 along the lower edge 116 thereof. The lower edge 116 of the crown 110 and the sweatband 130 are engaged with each other by inwardly bending a portion of a lower end of the crown 110. Particularly, the bent portion of the crown 110 is brought into close contact with the sweatband 130 and then the bent portion of the crown 110 and the sweat band 130 are stitched to be engaged. Next, the lower ends of the crown 110 and the sweat band 130 are wholly pressed and stitched together with a stretchable yarn, such that a stitch line 146 encircling the crown 110 is formed. The pressing stitch line 146 is parallel to the lower edge of the crown 110, and is visible on the outer side of the crown 110 to provide an aesthetic appearance.

The sweatband 130 includes a band core 132 therein, and an inward side of the band core 132 is covered with a stretchable fabric 136.

The stretchable fabric 136 is also woven with the wefts and warps each of which exhibits a stretch property because they are made of the stretchable yarn.

The band core 132 is made of a soft material and defines a core of the sweatband 130. Since the band core 132 allows the sweatband 130 to be comfortably wrapped around the wearer's head, a sense of pressing can be eliminated and a comfortable sense of wearing can also be provided even though it is used for a long time. The band core 132 can be composed of a soft material such as woven fabric, knit fabric, non-woven fabric and synthetic resin foam.

The stretchable fabric 136 is disposed on the band core 132 such that its weft direction is approximately coincident to a peripheral direction of the sweatband 130 or is slightly inclined thereto. Therefore, the sweatband 130 exhibits the stretch property in the peripheral direction of the wearer's head. The stretchable fabric 136 covers the inward face of the band core 132 and also partially covers upper and lower ends of the band core 132 so that a neat appearance of the sweatband 130 can be provided. Further, the upper and lower ends of the sweatband 130 are stitched with stretchable yarns 142 and 144 in order to engage the stretchable fabric 136 and the band core 132 with each other.

When stitching the lower ends of the sweatband 130 and the crown 110, a stretchable yarn is also used. The lower ends of the sweatband 130 and the crown 110 are stitched together along the lower edge 116 with the stretchable yarn such that a stitch line 146 is formed around the crown 110 adjacent to the lower edge 116. Since the stretchable yarn is stretchable along the lower edge 116 of the crown 110, the initial shape of the crown 110 can be maintained without any wrinkles and a high quality appearance of the headwear 100 can also be conserved using the stitching line 146 of the stretchable yarn.

When the wearer puts on the headwear 100, the crown 110 and the sweatband 130 can be stretched within a predetermined range in accordance with the head sizes of the wearer and secured around the wearer's head.

Further, as illustrated in FIG. 6, the lower end of the sweatband 130 is engaged with the lower edge 116 of the gores 112, whereas an upper end of the sweatband 130 is spaced apart from the gores 112. Therefore, the upper end of the sweatband 130 can additionally provide a comfortable sense of wearing because it can be flexibly secured around the head in accordance with the head shape of the wearer.

Furthermore, since the sweatband 130 includes the soft band core 132, its shape can be maintained and the comfortable sense of wearing can be provided. In addition, the sweat band may consist of only an elastic band to be attached to the inside of the head receiving part.

Embodiment 2

Figure 7:
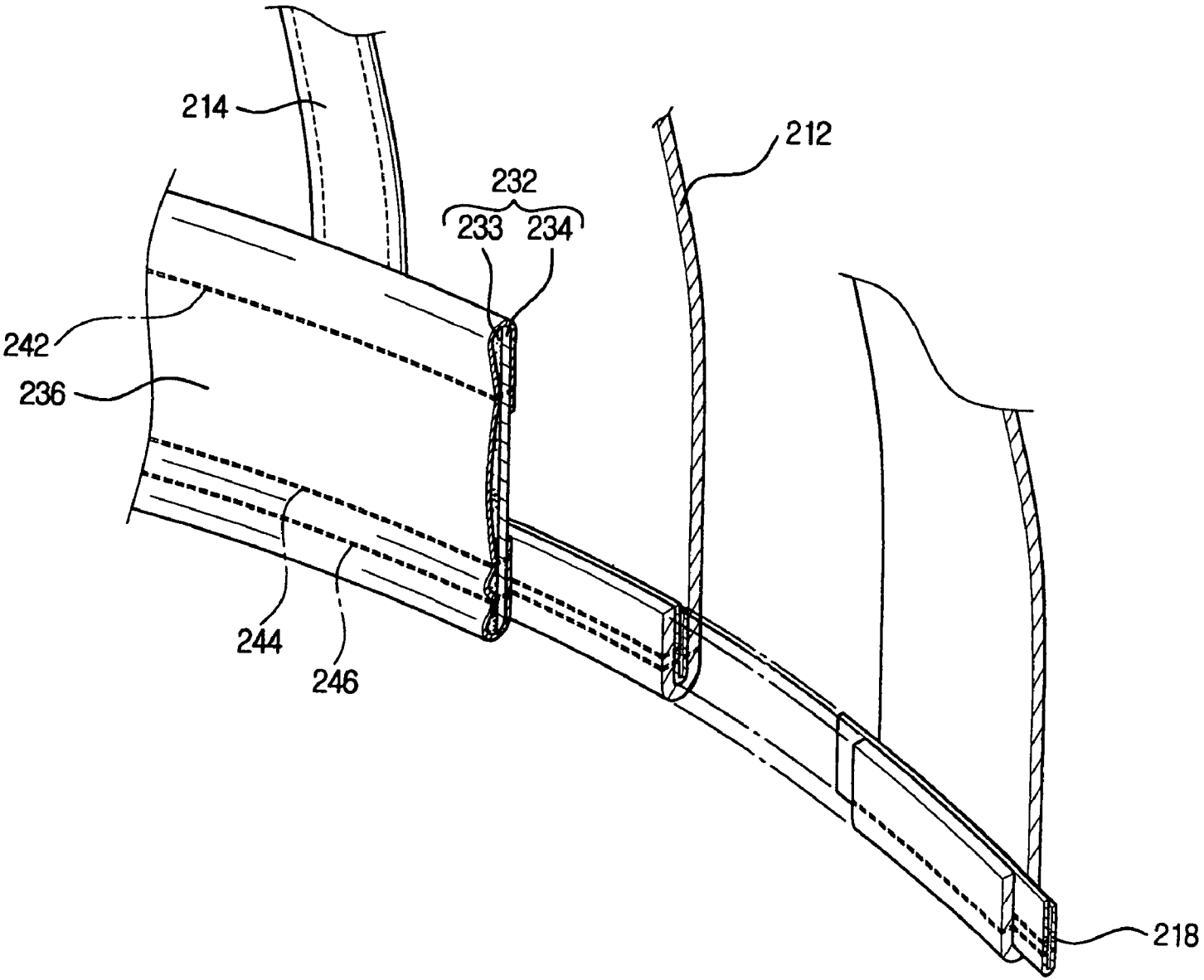
FIG. 7 is a partial cut-away view of a sweatband and a lower edge of the crown in a headwear according to the second embodiment of the present invention.
Figure 8:
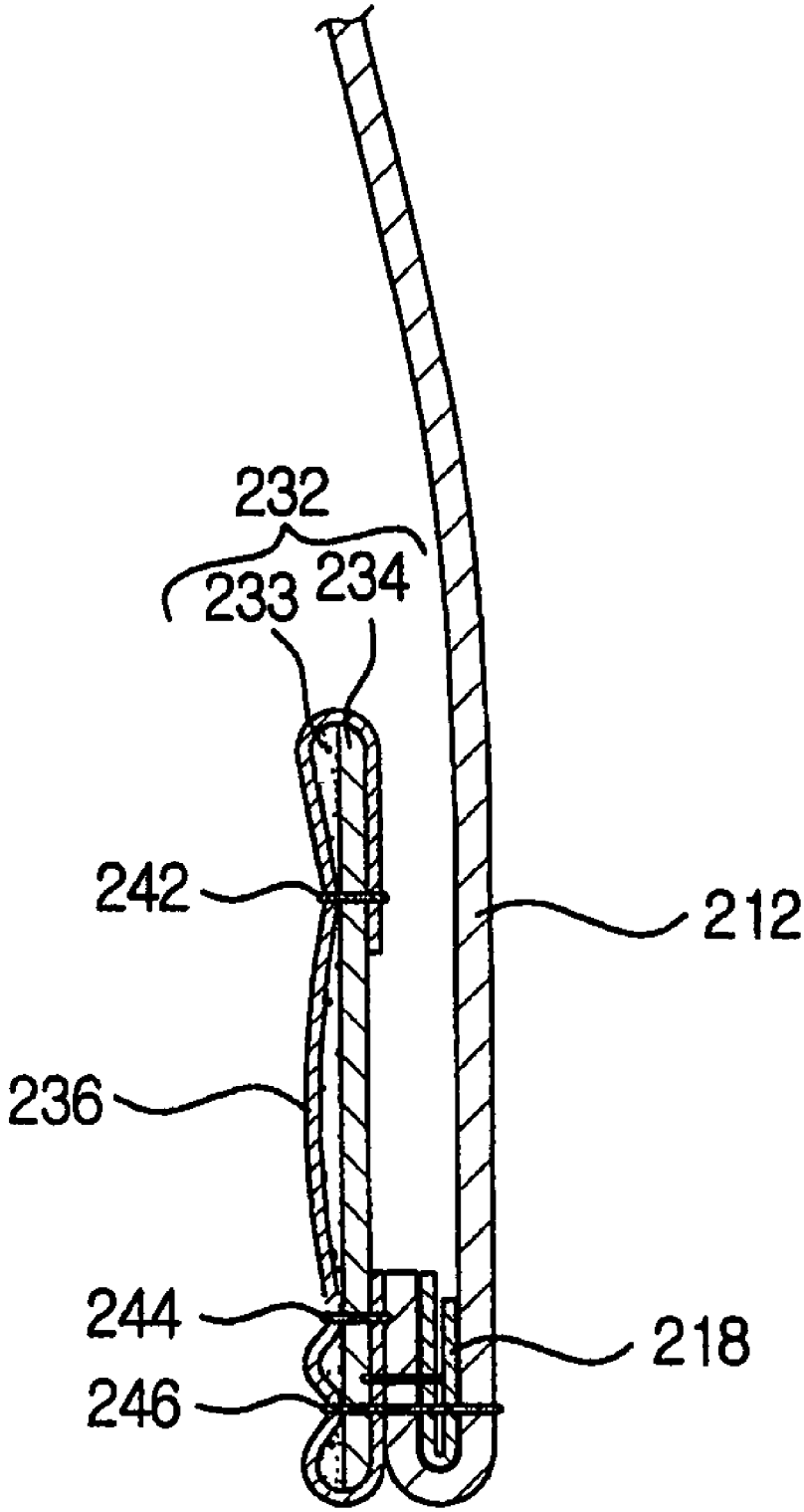
FIG. 8 is a sectional view of the sweatband of the headwear of FIG. 7.

FIG. 7 is a partial cut-away view illustrating the engagement between a sweatband and a crown in a headwear according to a second embodiment of the present invention, and FIG. 8 is a sectional view of the sweatband of the headwear according to the second embodiment. The headwear of the second embodiment may be described with reference to the description and figures of the previous embodiment and an iterative description thereof may be omitted.

Referring to FIGS. 7 and 8, the headwear of the second embodiment comprises a crown 210, a visor 220 and a sweatband 230.

The crown 210 is formed by connecting a plurality of panels. Inside the crown 210, bias tapes 214 are provided along inseams formed between adjacent gores 212 to cover the inseams, thereby sleekly treating an inner surface of the crown 210.

Similarly to the previous embodiment, the gores 212 include a double fabric A which is made by weaving the first warps R1, the second warps R2 and the wefts F using a method such as plain weave, twill weave or satin weave.

The wefts F can be stretched in the circumferential direction since they contain stretchable yarns. The wefts F alternately pass by the first warps R1 and the second warps R2, which are disposed one above another, according to certain rules and forms loops.

The double fabric A with such a structure has remarkably improved stretch property as compared with a conventional fabric and the crown 210 including the double fabric A can be applied to a wider range of head sizes.

The visor 220 is fixed to a front lower end of the crown 210 to function to shield direct sunlight. The sweatband 230 is attached to the inside of the crown 210, so that it can absorb oozing sweat and allow the headwear to be comfortably seated around a wearer's head.

The sweatband 230 is attached along a lower edge 216 of the crown 210. The lower edge 216 of the crown 210 and the sweatband 230 are engaged with each other by partially bending a lower end of the crown 210 comprising the gores 212 inwardly, bringing an inner surface of the bent portion of the crown 210 and an outer surface of a lower end of the sweatband 230 into contact with each other, and stitching them.

The sweatband 230 includes a band core 232 therein. The band core 232 comprises an inner polyurethane foam layer 233 and an outer elastic band layer 234. Further, an inner surface of the band core 232 with the polyurethane foam layer 233 formed thereon is covered with a stretchable fabric 236. In the meantime, the stretchable fabric 236 is also woven with wefts and warps containing stretch elastic yarns, such as spandex or polyurethane.

The inner surface of the band core 232 formed with the polyurethane foam layer 233 of soft material can provide a comfortable sense of wearing and the outer surface thereof formed with the elastic band layer 234 can allow the stretch of the sweatband 230.

The stretchable fabric 236 is disposed so that the direction of the wefts generally conforms to or is at a certain angle with respect to a circumferential direction of the sweatband 230. As a result, the sweatband 230 has the stretch property in a circumferential direction of a wearer's head due to the elastic band layer 234 and the stretchable fabric 236.

As described above, the stretchable fabric 236 covers the polyurethane foam layer 233 and partially cover upper and lower ends of the band core 232 so that the stretchable fabric 236 can partially cover a rear surface of the elastic band layer 234. Further, the upper and lower ends of the sweatband 230 are stitched with elastic threads 242 and 244 in order to engage the stretchable fabric 236 and the band core 232 with each other.

Even when the lower ends of the sweatband 230 and the crown 210 are stitched, an elastic thread 246 is also used. The lower ends of the sweatband 230 and the crown 210 are stitched along the lower edge 216 with the elastic thread 246 such that stitching line is formed around the crown 210 in the vicinity of the lower edge 216. Since the elastic thread 246 is stretchable along the lower edge 216 of the crown 210, the original shape of the crown 210 can be maintained without wrinkles and a high-grade external appearance of the headwear 200 can be maintained due to the stitching line of the elastic thread 246.

A shape tape 218 is formed on an inner surface of the lower edge 216 of he crown 210 along the periphery of the headwear. The shape tape 218 is located inside or adjacent to the bent portion of the lower edge 216 and stitched along the lower edge 216. As a wearer repeatedly wears the cap, the crown 210 also repeats the stretch so as to be fitted to the wearer's head. Therefore, the repeated stretch of the gores 212 can partially expands the gores 212, thereby affecting the external appearances of the cap. To deal with this, the shape tape 218 is stitched along the lower edge 216 of the crown 210 to prevent the gores 212 from being partially expanding, thereby maintaining the original shape of the crown 210 for a long time.

Referring to FIG. 6, when the wearer wears the headwear, the crown 210 and the sweatband 230 can be stretched within a predetermined range corresponding to the size of the wearer's head, so that they can be seated around the wearer's head.

Further, the lower end of the sweatband 230 is engaged with the lower edge 216 of the gores 212, whereas the upper end of the sweatband 230 is spaced apart from the gores 212. Thus, the upper end of the sweatband 230 can additionally provide a comfortable sense of wearing because it can be more securely seated around the head so as to be fitted to the shape of the wearer's head.

Since the sweatband 230 including the soft polyurethane foam layer 233 comfortably wraps the wearer's head, it provides the comfortable sense of wearing. The band core 232 including the soft polyurethane foam layer 233 can maintain the shape of the sweatband 230.

Although the present invention has been described in connection with the preferred embodiments, it can be understood by those skilled in the art that various changes and modifications can be made without departing from the spirit and scope of the invention defined by the appended claims.

What is claimed is:

1. A headwear, comprising:

a head receiving part made of a fabric; and a sweatband peripherally attached to an inner side of the head receiving part along a lower edge thereof, the fabric comprising first warps and second warps alternately arranged to be adjacent to each other, the first and second warps being arranged in vertically separated layers in an unstretched state of the head receiving part in which the headgear is not deformed by a user's head, the first warps overlapping the second warps in the unstretched state so that centers of the first warps are above spaces between adjacent ones of the second warps and sides of the first warps are above sides of adjacent ones of the second warps, and the first and the second warps being side-by-side in a stretched state of the head receiving part in which the headgear is deformed by the user's head, the fabric further including wefts, the wefts being stretchable yarns that encircle the warps to form loops in the unstretched state of the head receiving part.

2. The headwear as claimed in claim 1, wherein the head receiving part is a crown including a plurality of panels that are made of the fabric and are connected to one another to form the crown.

3. The headwear as claimed in claim 1, wherein the head receiving part is a headband peripherally receiving the head of a wearer.

4. The headwear as claimed in claim 1, wherein the first warps and the second warps have at least one common property.

5. The headwear as claimed in claim 1, wherein the second warps have a peculiar property in which the first warps are lacking.

6. The headwear as claimed in claim 1, wherein the sweatband includes an elastic band.

7. The headwear as claimed in claim 1, wherein the sweatband includes a band core and a stretchable fabric covering the band core against the head of a wearer.

8. The headwear as claimed in claim 7, wherein the stretchable fabric is made of the fabric.

9. The headwear as claimed in claim 7, wherein the stretchable yarns are uniaxially stretchable.

10. The headwear as claimed in claim 7, wherein the band core is composed of at least one selected from a group comprising a woven fabric, a knitted fabric, a non-woven fabric and resin foam.

11. The headwear as claimed in claim 7, wherein the band core comprises at least one selected from a group comprising an elastic band and polyurethane foam.

12. The headwear cap as claimed in claim 11, wherein the band core includes a polyurethane foam layer and an elastic band layer.

13. The headwear cap as claimed in claim 7, wherein the band core and the stretchable fabric are stitched with an elastic thread.

14. The headwear as claimed in claim 1, wherein lower ends of the sweatband and the head receiving part are wholly pressed and stitched together, along the lower edge thereof.

15. The headwear as claimed in claim 14, wherein the lower ends of the sweatband and the head receiving part are stitched with a stretchable yarn.

16. The headwear as claimed in claim 1, further comprising a shape tape attached adjacent to a lower end of the head receiving part, thereby maintaining the shape of the headwear.

17. The headwear as claimed in claim 16, wherein the shape tape is stitching along the lower end of the head receiving part.

18. The headwear as claimed in claim 1, wherein all of the first warps are below the wefts and all of the second warps are above the wefts.

19. The headwear as claimed in claim 1, wherein the wefts surround the warps in the unstretched state.

* * * * *